US007854221B1

(12) United States Patent
Gore

(10) Patent No.: US 7,854,221 B1
(45) Date of Patent: Dec. 21, 2010

(54) AIR GUN VIBRATION DAMPER AND METHOD

(76) Inventor: Thomas D. Gore, 67894 W. 8 Mile Rd., South Lyon, MI (US) 48178

( * ) Notice: Subject to any disclaimer, the term of this patent is extended or adjusted under 35 U.S.C. 154(b) by 339 days.

(21) Appl. No.: 12/194,615

(22) Filed: Aug. 20, 2008

(51) Int. Cl.
*F41B 11/00* (2006.01)

(52) U.S. Cl. ..... 124/63; 124/64; 124/65

(58) Field of Classification Search ..... 124/63–38; 42/74; 89/198, 7
See application file for complete search history.

(56) References Cited

U.S. PATENT DOCUMENTS 3,090,151 A 5/1963 Stewart et al.
4,388,855 A 6/1983 Sokolovsky
4,709,686 A * 12/1987 Taylor et al. ..... 124/67
4,771,758 A * 9/1988 Taylor et al. ..... 124/68
4,848,307 A 7/1989 Tsao
4,850,329 A 7/1989 Taylor et al.
5,261,384 A 11/1993 Hu
5,377,655 A 1/1995 Arad
5,570,676 A * 11/1996 Gore ..... 124/56

* cited by examiner

*Primary Examiner*—Troy Chambers
(74) *Attorney, Agent, or Firm*—Quinn Law Group, PLLC

(57) ABSTRACT

A gas spring having an internal vibration damper for an air gun charging system. The gas spring including a relatively thin liner which is received within and abuts the elongated inner and/or outer wall of the tubular gas spring. The liner(s) absorbs vibration in the air gun to improve firing performance. A guide sleeve mounted to the outer surface of the gas spring abuts an air gun's tubular compression piston to transfer any vibrations in the compression piston to the liner. A tubular counter-weight is slidably mounted about the outer wall of the gas spring and strikes a forward end of the charging system after the air gun is fired to counter the post-firing recoil.

20 Claims, 5 Drawing Sheets

AIR GUN VIBRATION DAMPER AND METHOD

FIELD OF THE INVENTION

This invention relates to air guns and more particularly to a vibration damper for the force producing/charging assembly of a gas spring air gun.

BACKGROUND OF THE INVENTION

Air guns use compressed air to discharge a pellet. Some air guns use a firing piston in a compression chamber. In a gas spring-type air gun, the air gun is charged by moving this compression piston toward the trigger to compress a gas contained within a gas spring's cylinder behind the compression piston.

The gas spring is mounted between the compression piston and a trigger mechanism. The compression piston is retracted to cock the trigger and to compress the gas contained within the gas spring. The gas within the gas spring is compressed by a second piston, hereinafter, the spring piston. When the trigger is released, the gas spring launches the compression piston toward the barrel to compress the air in the compression chamber. The compressed air then propels the pellet through the barrel. One problem with air guns using a gas spring is that the rapid deceleration of both the compression piston and the spring piston produce an excessive amount of vibration, shock, harmonics, and harshness (hereinafter collectively referred to as "vibration") upon firing.

These gas-powered air guns suffer from inaccuracy due to the vibration resulting from the rapid movement, then rapid deceleration of the pistons during firing. There is therefore a need for an improved air gun charging system damper that overcomes these and other drawbacks of prior art designs and techniques.

SUMMARY OF THE INVENTION

Vibrations exhibited by typical power spring air guns are damped by providing a damping component operatively connected to the power spring and configured to damp vibrations in the air gun when the air gun is fired. The damping component may have at least a portion that is annular, such as a sleeve or sleeve portion, concentrically surrounding at least a portion of the power spring and configured to contact the compression piston and the power spring. The damping component may be a layer of damping material on the tubular body that moves with the body free from contact with an air gun compression piston and a power spring piston. This layer damps the vibration in the power spring both during and after firing. The damping component may be a counterweight concentrically mounted with respect to the power spring and configured to counter recoil in the air gun after firing of the air gun.

In some embodiments, gas spring air gun vibrations are further damped by providing a narrowed neck at the forward end of the gas spring, this neck matingly grips the head of the gas spring's piston to trap the retainer head after the air gun is fired. The abutting relationship of the retainer head with the liner provides direct contact between the dampening liner and the rapidly decelerating component of the gas spring.

Still further, in some embodiments a guide sleeve surrounds at least a portion of the body of the bower spring. This sleeve may have a smooth low-friction outer surface which is sized to abut the inner surface of a conventional "skirted" air gun compression piston and guides the piston as the air gun is fired.

One advantage of the damper provided is that the damping component improves projectile velocities and accuracies by damping the vibrations caused by the power spring it is mounted to.

Another advantage of the damper is that when the damping component is a layer of damping material on the power spring, the damping component remains substantially apart from the moving portions of the power spring during the firing sequence.

Still another advantage of some embodiments of the damper is a layer that covers substantially the entire diametral surface of a tubular gas spring body, and provides a large surface area to abut and absorb vibrations from the power spring.

Yet another advantage of the damper is that in one embodiment, the inside mounted layer includes a narrow neck at the forward end of the power spring. This neck frictionally grips the retaining head of the spring's piston to prevent the piston from bouncing back from the post-firing position.

Still yet another advantage of an inside mounted layer embodiment having a narrowed neck is that the neck's abutting relationship to the piston when it is in a post-firing position transfers any vibrations in the piston to the vibration damping layer.

A further advantage of some embodiments of the damping component, in addition to guiding the skirted compression piston as it travels during a cocking and firing of the air gun, is that the abutting relationship between the damping component and the compression piston transfers any vibrations in the piston to the power spring and an attached vibration damping layer.

Still a further advantage is that in some embodiments a counter-weight is mounted the the spring body. The counterweight may be sized to fit within a skirted piston and is slidable within the piston such that when the air gun is fired and the skirted piston comes to an abrupt stop, the counterweight will slide and strike a portion of the air gun to counter the recoil effect of firing.

These and other objects, features and advantages of the present invention will become apparent from the following description when viewed in accordance with the accompanying drawings and claims.

BRIEF DESCRIPTION OF THE DRAWINGS

The description refers to the accompanying drawings in which like reference characters refer to like parts throughout the several views, and in which.

DETAILED DESCRIPTION OF THE INVENTION

Figure 1:
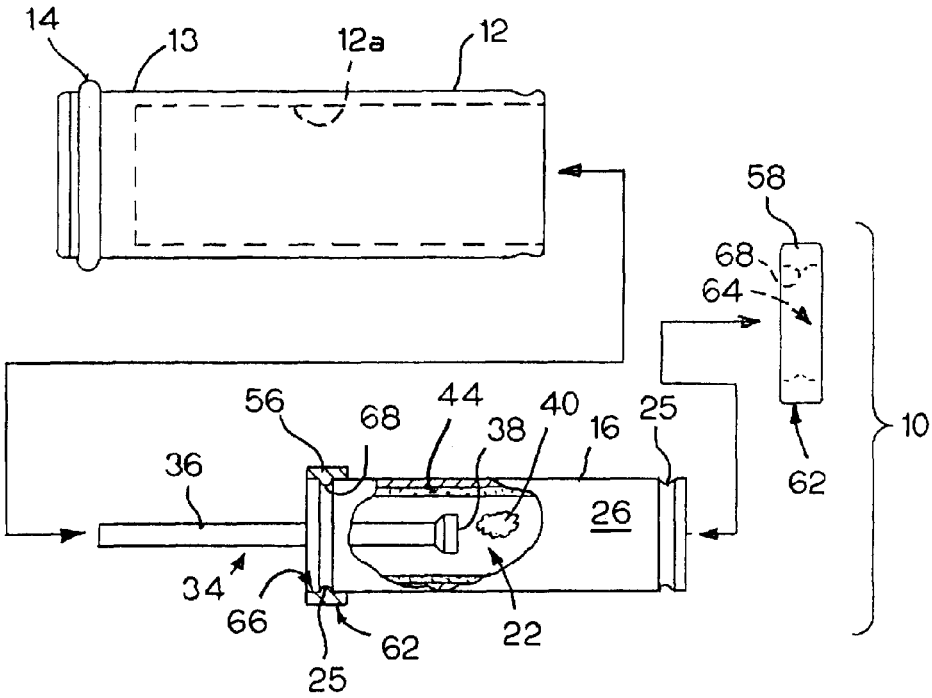
FIG. 1 is a partially exploded, partially cut-away side view of an improved gas spring along with a conventional skirted compression piston.
Figure 2:
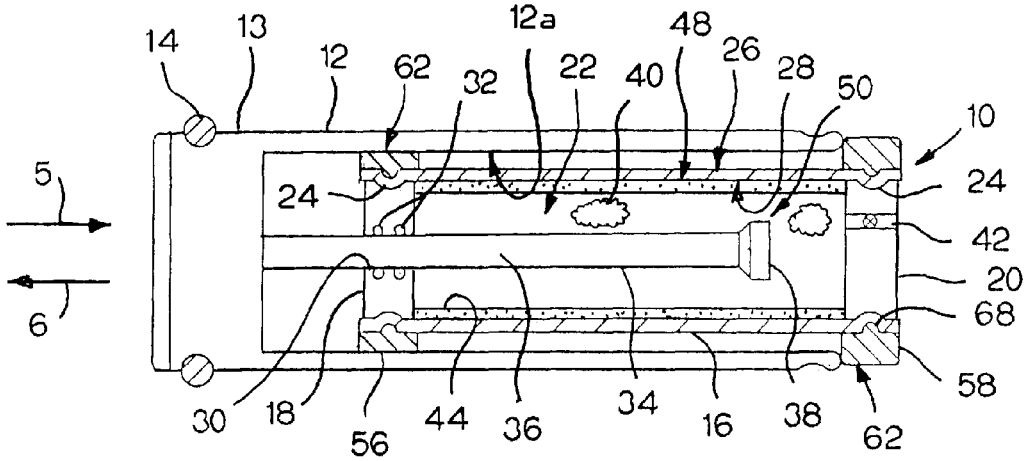
FIG. 2 is a side sectional view of the improved gas spring gun in a cocked position within a compression piston.
Figure 3:
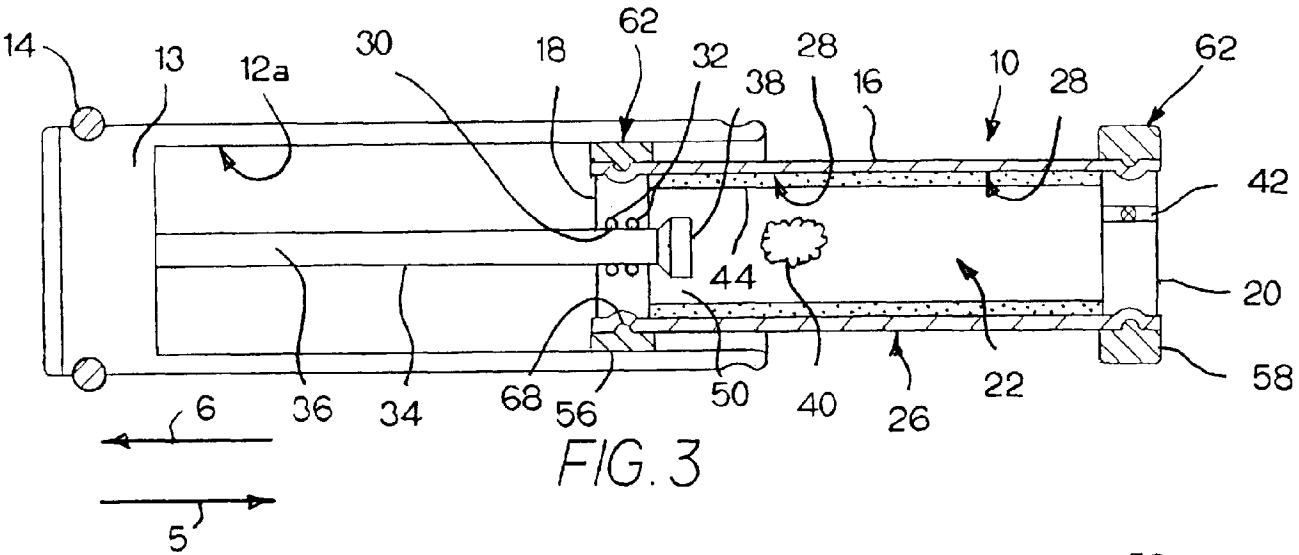
FIG. 3 is a side sectional view of the improved gas spring gun in a post-firing position within a compression piston.

Referring now to FIGS. 1-3, a gas spring 10 is shown along with a tubular shaped or skirted compression piston 12 for an air-powered pellet gun. The compression piston 12 is conventional and has a front end or head 13 having a dynamic seal or gasket 14 which creates an air-tight seal between compression piston 12 and the inner surface of the air gun's compression tube (not shown). In a typical air gun, the compression tube and compression piston 12 are substantially in-line with the air gun's barrel (not shown), such that once the air gun's trigger is pulled, the compression piston 12 moves toward the barrel and compresses the air in the compression tube in front of the piston head 13 expelling a projection, e.g., a pellet, out of the barrel.

Gas spring 10 includes an elongated tubular body 16. A pair of end walls or plugs 18, 20 are fixed to body 16 to define a pressure chamber 22. In the embodiment shown, plugs 18, 20 are fixed within the chamber 22 by roll forming annular projections 24 in body 16. By roll forming the projections 24, a small channel 25 is formed in the outer surface 26 of the body 16. It should be appreciated that plugs 18, 20 may be affixed to body 16 in substantially any manner suitable to create and air-tight condition within pressure chamber 22 and may include a seal or gasket (not shown) between the inner surface 28 of body 16 and the plugs.

Front plug 18 includes a central opening 30, which is preferably co-axial to the longitudinal axis of body 16. Opening 30 includes a dynamic seal or o-rings 32 that are mounted within concentric channels formed in the cylindrical inner wall plug 18.

Gas spring 10 further includes a piston 34. Piston 34 has an elongated and rigid piston rod 36. An enlarged retainer head 38 is mounted at one end of rod 36. Piston 34 is mounted within body 16 and projects through opening 30 with retaining head 38 contained within chamber 22. Dynamic seal 32 cooperates with rod 36 to create the air-tight condition within chamber 22. Piston 34 is movable axially from a cocked or ready-to-fire position, generally shown in FIG. 2, to a post-firing position shown in FIG. 3. As shown in FIGS. 2 and 3, the forward-most end of rod 36 engages a portion of the skirted compression piston 12, e.g., the rearward wall of head 13, such that movement of the compression piston 12 in the direction of arrow 5 (when cocking the air gun) will force rod 36 further into chamber 22; and such that movement of the gas spring piston 34 in the direction of arrow 6 (when the air gun is fired) will force the compression piston 12 toward the air gun's barrel.

An amount of pressurized gas 40, such as air, is trapped within chamber 22 and the additional volume occupied by the piston 34 when it is in the cocked position further pressurizes the gas 40. In the embodiment shown in the FIGs., an inlet valve 42 in rear plug 20 allows the pressure within chamber 22 to be adjusted.

Gas spring 10 further includes a liner or lining 44 of vibration damping or absorbing material. As shown, liner 44 is disposed within chamber 22 and abuts the inner wall 28 of body 16 face-wise. That is, the outer surface 48 of liner 44 conforms to and abuts substantially the entire surface of cylindrically-shaped inner wall 28. Liner 44 also preferably runs the entire length of chamber 22 to maximize the surface area covered by the vibration damping or absorbing liner. Liner 44 is preferably formed from an elastomeric material, such as rubber, which is sufficiently rigid to remain in place against the inner wall 28 of body 16, while still damping any vibrations that pass into the liner.

Importantly, liner 44 is relatively thin to leave an adequate gap 50 between its inner-most surface 52 and the radially projecting retaining head 38. This clearance or gap 50 ensures that the piston 34 will not be slowed by liner 44 when the gas spring is cocked/compressed and while the piston 34 is traveling forward when the air gun is fired, i.e., toward the post-firing position shown in FIG. 3.

Figure 4:
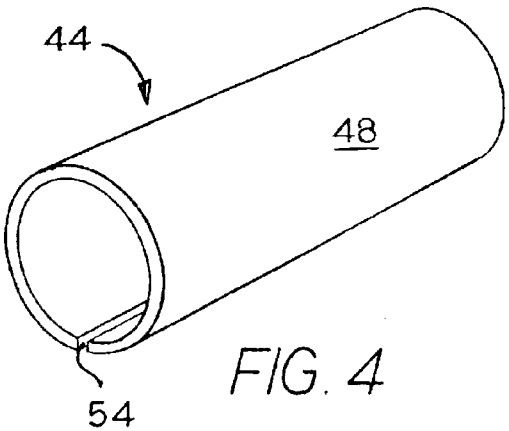
FIG. 4 is a perspective view of the vibration damping liner.

Referring now to FIG. 4, liner 44 is shown as a substantially contiguous sheet that may be rolled into the general shape of inner wall 28. In the embodiment illustrated, liner 44 is a flat sheet that is rolled into a cylindrical shape leaving a mating line or gap 54 running the length of the liner. Liner 44 is sized to compress slightly when it is inserted into body 16. This compressed fit within chamber 22 ensures the face-wise relationship between liner's outer surface 48 and inner wall 28. In other embodiments, liner 44 may be tubular in shape (i.e., no mating line 54) and sized to abuttingly fit against wall 28.

It should be appreciated that the inherently resilient nature of the vibration damping material, e.g., a rubber material, of liner 44 will cause it to press against inner wall 28 when liner 44 is compressed and inserted into chamber 22. In other embodiments, liner 44 may be further held against inner wall 28 by adhesives or other fastening means. Liner 44 by continuously abutting the gas spring body 16 during firing, transfers any vibrations in the gas spring 10 to the internally mounted vibration damping material of the liner 44 to reduce the vibration created during the firing process.

Figure 5:
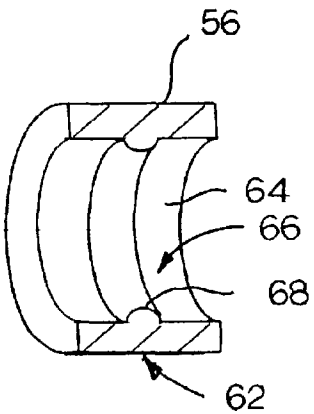
FIG. 5 is a sectional view of one of the guide sleeves.

Referring also now to FIG. 5, in the preferred embodiment, gas spring 10 further includes a pair of guide sleeves 56, 58 mounted to the outer wall 26 of body 16. Each sleeve 56, 58 is generally ring-shaped having a cylindrical outer wall 62 and a concentric opening 64 defined by an inner wall 66. As shown best in FIG. 3, the outer diameter of forward sleeve 56 is sized to slidably mate with the cylindrical inner wall 12*a* of the skirted compression piston 12, while the rearward sleeve 58 is preferably the same diameter as the piston 12.

Each sleeve 56, 58 is preferably a ring of durable and rigid material, such as a plastic. The outer wall 62 of sleeve 56 is preferably smooth and present little frictional resistance to the movement of skirted piston 12 relative to gas spring 10.

Sleeves 56, 58 includes means to grip the outer wall 26 of body 16 and fix the sleeves 56, 58 in place along the body. In the preferred embodiment, sleeves 56, 58 include at least one annular ridge 68 that projects radially inwardly from the inner wall 66. This ridge 68 is preferably shaped complementary to the roll formed channel 25 used to retain plugs 16, 18. The ridge 68 cooperates with channel 25 to fix the sleeves along body 16. It should be appreciated that other fasteners can be used in place of, or in addition to, the ridges/channels to hold the sleeves 56, 58 to the cylindrical body 16.

When an air gun is fired, the unloading of gas spring 10 not only presses compression piston 12 forward, but also creates vibrations in the air gun, which reduces performance. Further, the rapid deceleration of pistons 12 and 34 create additional vibration in the air gun. Sleeves 56, 58, by continuously abutting the skirted compression piston 12 during firing, transfers the vibrations in piston 12 to the liner damped gas spring 10 to reduce the vibration created during the firing process.

Figure 6:
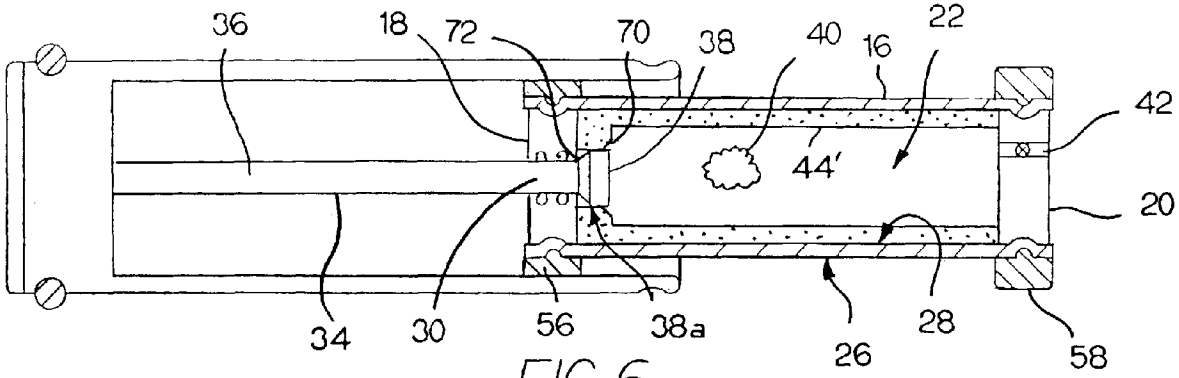
FIG. 6 is a side sectional view of an alternate embodiment of the gas spring's liner with the gas spring in a post-firing position.

In one embodiment, shown in FIG. 6, the liner, denote 44', includes an enlarged annular neck 70 at the forward-most end of the liner. This neck 70 is preferably formed from the same vibration damping material as the rest of the liner and projects radially inward to defines an opening 72 that is concentric to opening 30 and rod 36.

Opening 72 is sized to abuttingly and frictionally mate with the radially outer surface 38*a* of retaining head 38. In one embodiment, opening 72 is slightly smaller than (approximately 0.01 inches) the diameter of head 38.

As shown in FIG. 6, neck 70 only runs along the forward-most end of liner 44', such that neck 70 will not restrict the movement of piston 34 until the piston 34 is substantially at the post-firing position illustrated. The reduced size of neck 70 frictionally restrains the movement of the axially sliding piston 34 and substantially prevents the piston 34 from bouncing back in the direction of arrow 5 after the air gun has been fired.

The direct engagement of the vibration damping liner's neck 70 with piston 34 (which abuts the compression piston 12) provides an additional path for any vibrations in the pistons 12, 34 to travel into the vibration damping material of liner 44' when the gas spring 10 is in the post-firing position.

Figure 7:
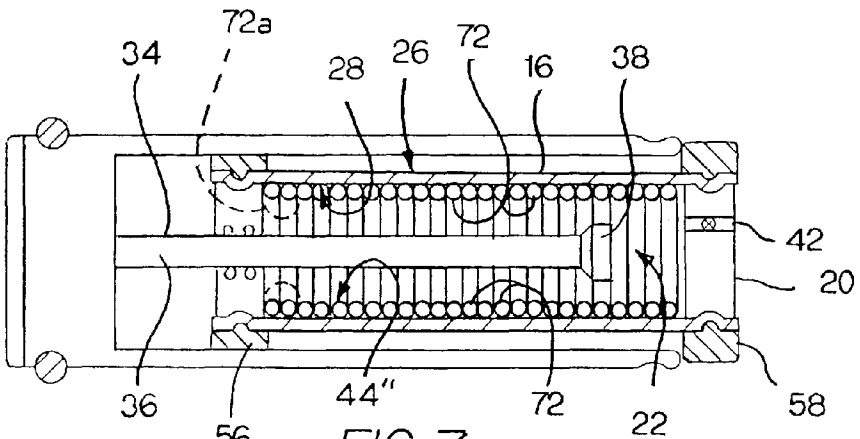
FIG. 7 is a side sectional view of another alternate embodiment of the gas spring's liner with the gas spring in a cocked position.

Referring now to FIG. 7, yet another embodiment of the gas spring liner, denoted 44", is shown as a plurality of individual elastomeric o-rings 72, which are stacked adjacently and abuttingly along the entire length of chamber 22. The o-rings 72 are preferably sized such that they are slightly compressed by wall 28 when inserted into body 16. In another embodiment shown in phantom, the neck 70 shown in FIG. 6 can be replicated by using o-rings 72*a* at the forward-most end of the tube having an appropriately sized inner diameter (i.e., using thicker o-rings).

Figure 8:
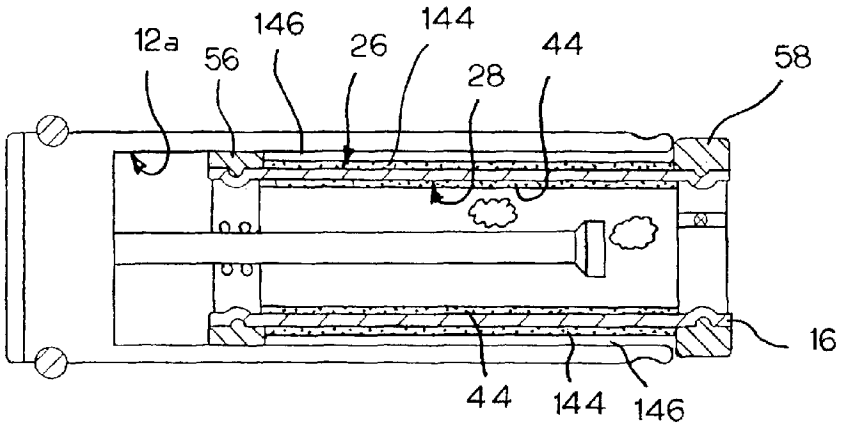
FIG. 8 is a side sectional view of still another embodiment of a gas spring having a liner mounted on both the inner and outer surface of the gas spring cylinder.
Figure 9:
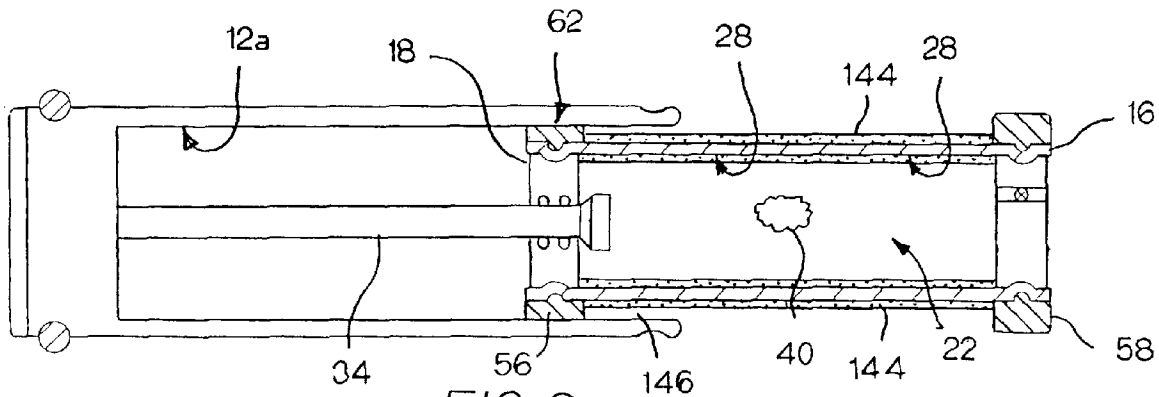
FIG. 9 is a side sectional view of the embodiment illustrated in FIG. 8 in a post-firing position.

Referring now to FIGS. 8 and 9 an alternate embodiment is illustrated where a second liner 144 is mounted to the outer surface 26 of the cylinder. Liner 144 is substantially the same as liner 44 described above, but is abuttingly mounted to outer surface 26 between the sleeves 56, 58. This second layer of vibration damping material acts to supplement the damping effects of the single liner 44 described above.

It should be appreciated that the outer liner 144 is sufficiently thin to ensure that there is clearance, shown as a gap 146, between the liner 144 and the inner surface 12*a* of the piston. In this manner, the vibration damping outer liner 144 does not interfere with the firing and cocking operations of the air gun.

Figure 10:
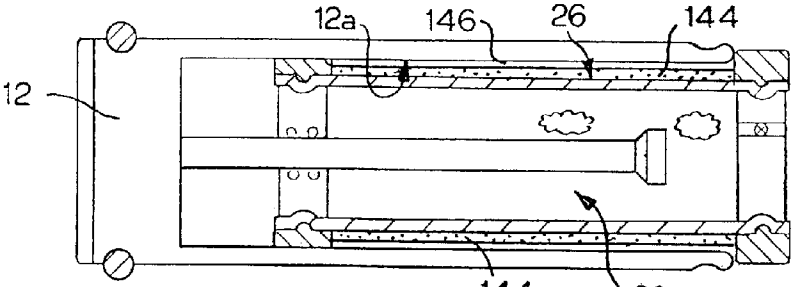
FIG. 10 is a side sectional view of yet another embodiment of a gas spring having a liner mounted to the outer surface of the gas spring cylinder.

In another embodiment, shown in FIG. 10, the inner liner 44 may be eliminated and only the outer liner 144 operates to receive and damp any vibrations in the air gun.

Figure 11:
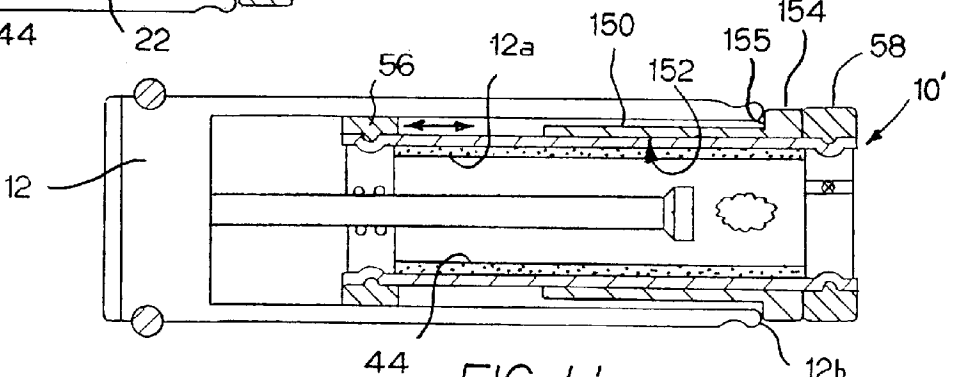
FIG. 11 is a side sectional view of still yet another embodiment of the present invention having a slidable counterweight mounted to the outer surface of the gas spring cylinder, shown in a cocked position.
Figure 12:
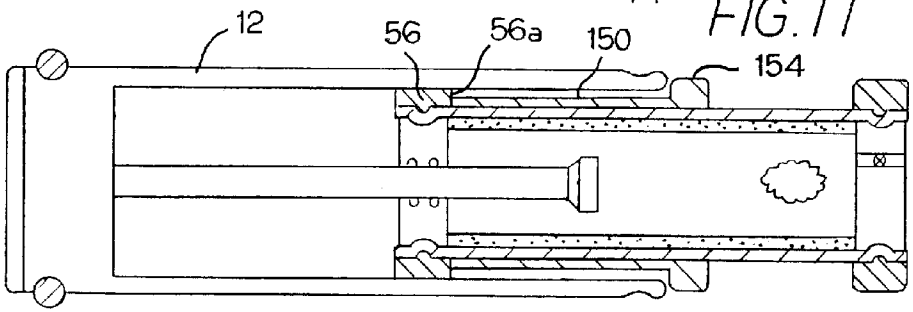
FIG. 12 is a side sectional view of the embodiment illustrated in FIG. 11 in a post-firing position.

Referring now to FIGS. 11 and 12, still another embodiment of invention showing a gas spring 10' having an internal liner 44 as described above. In addition to the vibration damping liner 44, gas spring 10' includes a tubular-shaped counter-weight 150 that is slidably mounted around the outer surface 26 of the gas spring cylinder 16. The inner diameter of the tubular counter-weight is such that a sliding fit exists between the outer surface 26 and the inner surface 152 of the counter-weight.

As shown, the forward portion of counter-weight 150 is sized to fit within the skirted portion of a piston 12, while remaining free to slide axially along the gas spring surface 26 between the guides 56, 58. The rearward end of the counter-weight terminates at an enlarged annular head 154. Head 154 extends radially from the otherwise relatively thin profile such that the rearward end 12*b* of piston 12 may abuttingly engage a forward shoulder 155 of the head.

Counter-weight 150 is preferably formed from a high density material, such as tungsten carbide. In operation, the counter-weight 150 is pressed back adjacent to the rear guide sleeve 58 by the piston 12 when the air gun is cocked. Upon firing, the piston 12 moves rapidly away from the gas spring 16 and counter-weight 150. Once the piston 12 reaches the forward-most point of its travel, it comes to an abrupt stop while causing the pellet in the air gun to fire and the air gun to recoil from the discharge of the pellet and the compressed air. This recoil effect causes the counter-weight 150 to slide axially along the gas spring and strike the rearward side 56*a* of forward guide sleeve 56 to counter the recoil effect of firing the air gun. In other embodiments, shoulder 155 strikes the rearward end 12*b* rather than the forward end of the counter-weight striking the guide sleeve.

In another embodiment, the rear guide sleeve 58 may be eliminated and replaced with counter-weight 150. In this embodiment (not shown), the counter-weight may include, like sleeve 58, means to frictionally mate with the rearward groove 25 in the cylinder 16. In still other embodiments, the counter-weight 150 may be slidably mounted around a gas spring having a vibration damping outer liner 144.

In still other embodiments, the liner may initially be a liquid elastomeric material, which is applied to the body's inner wall 28 (and/or its outer wall 26). In the preferred version of this embodiment, a layer of vibration damping material is sprayed onto the wall(s) as a liquid and allowed to cure or set to form a layer or liner 44.

The invention has been described in an illustrative manner, and it is to be understood that the terminology, which has been used, is intended to be in the nature of words of description rather than of limitation. It is to be understood that the invention is not limited to the exact construction or method which has been illustrated and discussed above, but that various changes and modifications may be made without departing from the spirit and the scope of the invention as is more fully delineated in the following claims.

The invention claimed is:

1. A damper for an air gun's gas spring having a body with an interior chamber defined by an inner wall and an axially movable gas spring piston having an enlarged retaining head disposed within said interior chamber, comprising:

a liner of vibration damping material that conforms to and abuts the inner wall face-wise, said liner is disposed within said interior chamber to remain remote from said gas spring piston while said air gun is fired.

2. A damper as defined in claim 1, wherein said gas spring is telescopically received within a skirted compression piston, which is co-extensive with the air gun's barrel, comprising:

a rigid, tubular front sleeve mounted around a front end of said body, said sleeve is sized to slidably and abuttingly engage an inner wall of said compression piston;

wherein said abutting engagement transfers any vibrations in said compression piston to said liner through said sleeve and body.

3. A damper as defined in claim 1, wherein said liner is a contiguous sheet of elastomeric material.

4. A damper as defined in claim 1, wherein said liner comprises a plurality of co-axially aligned abutting o-rings.

5. A damper as defined in claim 3, wherein said liner is applied to said inner wall as a liquid, which is cured to a substantially solid form.

6. A damper as defined in claim 1, wherein the retaining head is disposed at a rearward end of said piston, wherein said liner further comprises an annular neck which projects radially inward from a forward end of said liner, said neck matingly grips a radially outer surface of the retaining head when said piston is at a forward post-firing position.

7. A damper as defined in claim 2, wherein the body include a cylindrical outer wall and said liner is a first liner, comprising: a second liner of vibration damping material that conforms to and abuts the outer wall face-wise, said second liner is disposed about said outer wall to remain remote from said skirted compression piston.

8. A damper as defined in claim 2, further comprising: a tubular counter-weight having a relatively thin body and an annular head extending radially from a rearward end of the body, the counter-weight being mounted concentrically about the gas spring body and is mounted to the body to slide axially along an outer surface of the body, wherein said thin body is sized to fit within and remain remote from said skirted piston, while said annular head is sized to abutting engage a rearward end of the skirted piston.

9. An improved gas spring having an elongated tubular body, the body having oppositely facing inner and outer walls, wherein said gas spring is telescopically mounted within a tubular air gun compression piston, which is co-extensive with the air gun's barrel, the improvement comprising:

a thin layer of vibration damping material that abuts a body wall face-wise substantially along the entire length of the body; and a tubular sleeve that matingly receives the body, said sleeve having an outer surface that abuts an inner wall of the air gun's compression piston;

wherein said sleeve is effective to transfer vibrations in the air gun to the layer of vibration damping material through the gas spring.

10. An improved gas spring as defined in claim 9, wherein said vibration damping material is an elastomer.

11. An improved gas spring as defined in claim 9, wherein said sleeve has an annular ridge extending from an inner surface, said ridge frictionally gripping a portion of the outer surface of the body.

12. An improved gas spring as defined in claim 9, wherein the gas spring has an axially movable gas spring piston having a retaining head at a rearward end of the gas spring piston, said layer of damping material having an annular neck that projects radially inwardly at a forward-most end of the layer, said neck frictionally engages the retaining head when the spring piston is in a post-firing position.

13. An improved gas spring as defined in claim 9, wherein said thin layer of vibration damping material is a first layer and that abuts said inner wall, said improvement further comprising: a second thin layer of vibration damping material that abuts the outer wall face-wise substantially along the entire length of the body.

14. An improved gas spring as defined in claim 9, further comprising counterweight means that is slidably mounted to the outer wall, the counterweight means being effective to counter recoil in the air gun after firing the air gun by sliding forward along the outer wall and striking a portion of the air gun.

15. A method of forming a damped gas spring for an air-powered pellet gun, comprising the steps of:

providing a tubular gas spring body having elongated inner and outer walls;

providing a liner of vibration damping material;

abutting the liner face-wise against at least one of the gas spring body walls;

telescopically and sealingly mounting a gas spring piston to the body, whereby a retaining head of the piston is enclosed by the body and slides substantially free of the liner.

16. A method as defined in claim 15, wherein the damped gas spring is adapted to be received within an air gun's tubular compression piston, which is co-axial to the air gun's barrel, further comprising the steps of:

mounting a rigid, tubular sleeve sized to receive a forward end of the outer wall and to abut a surrounding inner surface of the compression piston;

said sleeve being effective to transfer vibration from said air gun to said body and said liner.

17. A method as defined in claim 16, further comprising the step of:

narrowing a front end of the liner to frictionally receive the retaining head when said piston is in a post-firing position.

18. A method as defined in claim 15, wherein the step of abutting the liner comprises:

spraying a liquid vibration damping material against the inner walls; and curing the liquid to a substantially solid state.

19. A method as defined in claim 16, wherein said body includes an annular depression formed into the outer wall, wherein the step of mounting the sleeve further comprises:

mating an annular projection extending from an inner surface of the sleeve with the annular depression.

20. A method as defined in claim 19 further comprising the steps of:

providing a tubular-shaped counter-weight having an enlarged rearward annular head; and slidably mounting the counter-weight concentrically about the outer wall, wherein the counter-weight is moveable from a cocked position where a forward end of the counter-weight is remote from the sleeve to a post-firing position where the counter-weight strikes a portion of the pellet gun and is adjacent to the sleeve.

* * * * *